United States Patent [19]

Holder, Jr.

[11] 3,982,056

[45] Sept. 21, 1976

[54] METHOD FOR IMPROVING THE PRINTABILITY CHARACTERISTICS OF GLOSS CALENDERED PAPER

[75] Inventor: Charles Delbert Holder, Jr., Mobile, Ala.

[73] Assignee: International Paper Company, New York, N.Y.

[22] Filed: Oct. 15, 1974

[21] Appl. No.: 514,739

[52] U.S. Cl. ..... 427/361; 427/362; 427/366

[51] Int. Cl.[2] ..... B05D 3/12

[58] Field of Search ..... 427/361, 370, 211, 362, 427/366; 162/119, 135, 136, 207

[56] References Cited

UNITED STATES PATENTS

| | | | |
|---|---|---|---|
| 1,595,473 | 8/1926 | Minton | 427/361 X |
| 1,900,166 | 3/1933 | Dix | 162/119 X |
| 1,962,882 | 6/1934 | Shotwell | 427/211 X |
| 2,091,805 | 8/1937 | Chuse | 427/370 X |
| 2,214,641 | 9/1940 | Massey et al. | 162/136 X |
| 2,314,797 | 3/1943 | Morris et al. | 162/135 |
| 2,337,163 | 12/1943 | Milne | 427/362 |
| 2,367,587 | 1/1945 | Knapp | 427/211 X |
| 2,661,669 | 12/1953 | Friedrich | 427/370 |
| 2,769,725 | 11/1956 | Hart | 162/135 X |
| 2,919,205 | 12/1959 | Hart | 427/211 |
| 3,024,129 | 3/1962 | Brundige | 427/361 X |
| 3,041,200 | 6/1962 | Steffin | 162/119 X |
| 3,320,086 | 5/1967 | Rose et al. | 427/366 X |

*Primary Examiner*—Michael R. Lusignan
*Attorney, Agent, or Firm*—Ronald A. Schapira

[57] ABSTRACT

The printability characteristics of gloss calendered paper coated on one side only is improved by moistening the uncoated side of the paper prior to gloss calendering the paper. Enough liquid must be applied to the uncoated side to raise the overall moisture content to at last about 8.5% and preferably to about 10% or more. The paper is gloss calendered while still wet and before appreciable amounts of the added liquid can migrate to the coated side of the paper. Thus a localized zone of high moisture content is provided at the uncoated side of the paper during the calendering. Under such conditions the gloss calendering produces a paper whose printability characteristics, especially its print smoothness, are better than conventional gloss calendered paper and, under preferred operating conditions, approach or equal those of conventional supercalendered paper. The ability to produce paper of supercalendered printing quality on the less expensive, easier to operate gloss calender is an important advantage, especially since the gloss calenders are normally on line with the coating equipment in papermaking plants while supercalenders are not.

17 Claims, 1 Drawing Figure

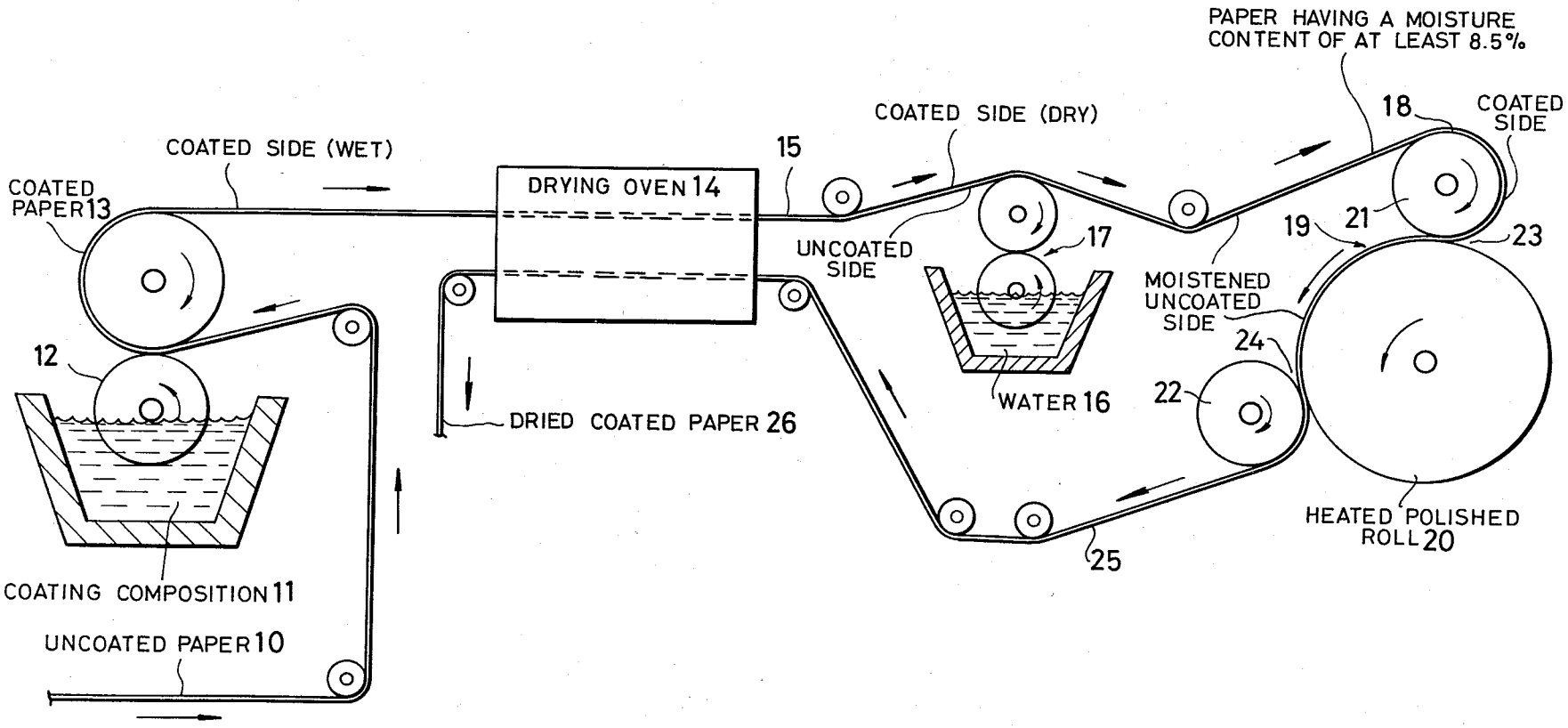
PAPER HAVING A MOISTURE CONTENT OF AT LEAST 8.5%
COATED SIDE
18
23
21
19
HEATED POLISHED ROLL 20
MOISTENED UNCOATED SIDE
24
22
25
17
WATER 16
COATED SIDE (DRY)
UNCOATED SIDE
15
DRYING OVEN 14
DRIED COATED PAPER 26
COATED SIDE (WET)
COATED PAPER 13
12
COATING COMPOSITION 11
UNCOATED PAPER 10

METHOD FOR IMPROVING THE PRINTABILITY CHARACTERISTICS OF GLOSS CALENDERED PAPER

BACKGROUND OF THE INVENTION

This invention relates to a method for improving the printability characteristics of gloss calendered paper such as label paper or other paper which is coated on one side only. Such papers are normally prepared by applying to one surface of a suitable paper substrate a liquid coating composition. A variety of conventional application techniques using devices such as trailing blade coaters, air knife coaters, roll coaters and such are used. The coating normally includes a pigment, such as clay or titanium dioxide, and a binder which joins the pigment to the surface of the paper. Casein and various starches are well known naturally-occuring binders although numerous other binders, both natural and synthetic, are known to those skilled in the art. The coated paper is then normally dried to a moisture content less than about 80%, and typically about 4 to 6%, to set the coating and render the paper suitable for further processing to develop its printability characteristics.

Coatings are applied to paper in order to improve its appearance and printability characteristics. to maximize these properties, the common practice is to subject the coated paper to further processing to improve such properties as the gloss of the paper and the surface characteristics of the coating so that it becomes more receptive to print.

Several techniques are conventionally used for this purpose, with the degree of improvement which is obtained normally depending upon the particular tenchique chosen. One technique is referred to by those skilled in the art as "gloss-calendering." In this process, the paper is passed through a nip formed between a heated highly polished revolving non-deformable roll (which in some cases may be a chrome plated roll revolving at high speed) and one or more deformable rolls which can be made from a variety of materials. The relatively dry coated surface of the paper is pressed against the surface of the highly polished roll in the nip and takes on, as nearly as possible, the polished surface of the roll. This produces a coated paper of improved gloss and printability characteristics. In the gloss-calendering operation, it is well known that the coating must have a low moisture content, e.g., 4–6% by weight. Otherwise, the coating tends to stick to the rolls during the calendering.

In another technique commonly referred to as "cast coating", the coated surface of the paper is pressed against the highly polished surface of a heated revolving drum while the coating is still quite wet (usually containing about 25 to 40% moisture at the drum surface) and the coating is dried while in contact with the heated drum. The coating takes on the highly polished surface of the drum as it dries and produces a paper having superior gloss and printability characteristics. A disadvantage of this process, however, is its slowness necessitated by the residence time on the drum required to dry the coating. Thus the cast coating process typically processes the coated paper at only about ¼ to ½ the speed of a normal coater operation. Production is usually much slower in a cast coating process than, for example, in a conventional trailing blade coating operation.

Another method of improving the appearance and printability of coated paper is the well known "supercalendering" operation in which the paper is passed through a stack of high pressure alternating metal and deformable rolls which cause the paper to slide faster on one side than the other as it passes through the nips of the rolls. This improves the gloss and printability characteristics of the paper but by a mechanism different than that of the gloss calender. In the supercalender, where polished rolls are not used, the improved properties result from the creep caused by the slippage of the paper in the nip, whereas in the gloss calender, the coated surface simply takes on the smooth polished surface of the drum it is pressed against. While the supercalender generally produces paper of better print quality than a gloss calender, it has several disadvantages. First, it is a difficult machine to operate and control. Paper has a tendency to stick to the rolls and break, necessitating a time-consuming rethreading of the entire stack of rolls. Moreover, supercalenders are usually not located in line with the coating equipment in most paper-making plants, resulting in process inefficiency and increased product waste. Finally, because of the high pressures required, the paper is significantly reduced in caliper making it less stiff and therefore more difficult to feed to a printing press. This undesirably slows down the operating speed of the press.

Supercalendered paper normally has gloss and printability characteristics superior to gloss calendered paper. However the gloss calender has several advantages over a supercalender which would make it an attractive replacement for the supercalender if both machines produced a product of comparable quality. For example, the gloss calender is a less expensive and complicated machine, and is significantly easier to operate. It usually runs with less paper breaks and can be quickly restarted should the paper break. Since it operates at a lower pressure than the supercalender, it does not reduce the thickness of the paper as much, producing a stiffer sheet which can be fed to the printing presses at a faster rate than supercalendered paper. Gloss calendered paper also normally has a higher backside roughness which reduces the tendency of the paper to stick together, again providing for better feeding of the paper to a printing press. Finally, gloss calenders are typically located directly in line with the coating equipment in many paper-making plants so that paper from the coating equipment can proceed directly and continuously to the gloss calender for maximum process efficiency and minimum product waste. Numerous advantages would be apparent to those skilled in the art if a means could be found to use a gloss calender to produce paper whose quality approximated or equalled that of supercalendered paper.

It is a general object of this invention, therefore, to provide a method whereby paper coated on one side can be processed in a conventional gloss calender to produce a paper product whose printability characteristics approximate or equal those of supercalendered paper.

It is another object of this invention to provide a method for improving the print smoothness of gloss calendered paper to a level which approximates or equals that of supercalendered paper.

These and other objects of the invention will be apparent to those skilled in the art upon a consideration of this entire specification.

SUMMARY OF THE INVENTION

The above objectives are accomplished, in accordance with the invention, by subjecting paper coated on one side only to a pre-moistening treatment before the paper is gloss calendered. In this treatment, a liquid such as water is applied to the uncoated side of the paper in an amount sufficient to impart to the paper an overall moisture content of at least about 8.5% by weight and preferably at least about 10% or more. In conventional operation, paper fed to a gloss calender contains far less than 8.5% water, usually only about 4 to 6% water, because of the generally recognized problem that excessive wetness causes the coating to undesirably stick to the gloss calender rolls. The application of water to the uncoated side only, as contemplated in the present invention, while elevating the overall moisture content to 8.5% or more, creates in the paper a localized zone of high moisture content located generally along the uncoated side of the paper only, in which the moisture level far exceeds the average or overall moisture content of the paper.

The paper moistened on one side is then gloss calendered before the overall moisture content again falls below about 8.5% and before appreciable amounts of the moisture added to the uncoated side can migrate through the paper to the coated side. Once the coated side becomes excessively wet, the coating has a marked tendency to undesirably stick to the gloss calender rolls as discussed above. This usually begins as the coating moisture content approaches about 8% by weight or more. Thus, in the present invention, the paper is gloss-calendered before sufficient water migration to the coated surface takes place to cause the coating to stick to the gloss calender. In normal operation, the gloss calender is in line with the moisture applying equipment and the paper is gloss calendered almost immediately or within a few seconds at most, after the water is applied to the uncoated side. When this procedure is followed, virtually all the water remains in the paper and the added moisture is still highly localized at the uncoated side of the paper. The coated surface is usually quite dry, typically containing only its normal ambient moisture content of about 4 to 6% by weight at the time it is calendered.

As is now apparent, the present invention envisions gloss calendering a coated paper having an overall high moisture level in the range which normally causes sticking of the coating to the gloss calender rolls, but in which sticking does not occur because the water is unevenly distributed throughout the thickness of the paper with most of its localized at the uncoated side of the paper where it does not cause sticking.

The amount of moisture added to the uncoated side of the paper has a marked effect upon the efficacy of the treatment in developing improved printability characteristics. Little if any improvement is observed when the overall moisture content of the paper is below about 8.5% by weight during the calendering. Preferably, at least about 10% moisture or more should be present in the paper during calendering. Paper does of course retain an ambient moisture content, depending upon the conditions of its environment, which illustratively is about 4 to 6%, and this is the state in which coated paper is normally gloss calendered. However, as discussed above, such paper does not have as good properties as supercalendered paper. Nor will the addition of only small amounts of water to the uncoated side improve these properties. It is only when a relatively large water addition is made that improvement is noted.

"Gloss-calendering" itself is a term and operation well understood by those skilled in the art, as a common technique used to finish coated papers. To gloss calender a coated paper, it is passed through an apparatus called a gloss calender which comprises a heated revolving drum or roll having a highly polished glossy smooth surface and one or more deformable drums or rolls loaded against the polished drum to form one or more nips with the polished drum. The polished drum is not deformable and may be chrome surfaced to provide the highly polished glossy surface required. In operation, the coated surface of the paper is pressed against the polished surface of the heated drum as it passes through the nips of the gloss calender and the coated surface takes on as nearly as possible the smooth glossy polished surface of the drum. This treatment is well known to improve the appearance and printability characteristics of the paper.

Although the precise nature by which moistening the uncoated side of the paper improves the printability characteristics of the gloss calendered paper is not known with certainty, it is theorized that the mechanism resides in the altered nature of the paper substrate caused by the one side moistening. When the sheet of paper is moistened, a zone of high moisture content is created at the uncoated side which extends somewhat into the paper and which may have a localized moisture content as high as 20 to 40% by weight. This is thought to permit some of the stresses inherent in the relatively dry paper to relax and render the paper substrate more pliable. This may then permit the coating layer to be pressed much closer to, and be polished more by, the polished drum than in a dry gloss calendering operation. Once the calendering is completed, the paper is usually dried to remove the added moisture and restore it to its normal ambient moisture level of about 4 to 6%. As this occurs, internal bonding returns to the previously pliable "wet" zone of the paper, pliability diminishes and internal stresses return. This is thought to "lock in" the desirable printability characteristics of the paper. The above theory is offered by way of possible explanation only and, of course, is in no way intended to be binding.

Since in the present invention, the coating layer is not excessively wet, it does not stick to the polished drum in the gloss calender. Furthermore, there is no requirement to dry the coating while it is in contact with the polished drum, as in the cast coating process. This permits the gloss calender to operate at its normal rapid speed, a speed fast enough to handle the output of the coating equipment which is usually in line with the gloss calender. Finally, since the water is applied only to the uncoated side, water vapor formed when the paper is in contact with the heated polished drum is not forced through the coating layer in its escape route, thereby avoiding disruptions in the surface structure of the coating. In the present invention, this vapor escapes out the uncoated side of the paper where damage to the paper does not occur.

The print smoothness of gloss calendered paper prepared in accordance with the invention is superior to that of conventional gloss calendered paper and, under preferred conditions, is comparable to that of supercalendered paper. Thus the less expensive, easier to operate gloss calender normally in line with the coating equipment can be used instead of an off line supercalender. The invention also provides a printing surface comparable to supercalendered paper but on a thicker, stiffer sheet whose back side roughness is higher than supercalendered paper. This permits printing presses to feed and operate more rapidly than with supercalendered paper, but without sacrificing print quality. These significant advantages are achieved by a relatively inexpensive water addition step which can be readily incorporated into an existing coater-gloss calender in-line operation for greater process efficiency and reduced product waste, and without increasing the opacity of the paper.

BRIEF DESCRIPTION OF THE DRAWING

The drawing is a schematic flowsheet illustrating the process of the invention.

DESCRIPTION OF THE PREFERRED EMBODIMENTS

The drawing illustrates the steps of coating a paper substrate on one side, drying the coated paper, applying moisture to the uncoated side of the paper in accordance with the invention, gloss calendering the moistened paper to produce a product whose properties are superior to those of conventional dry gloss calendered paper, and finally drying the paper to a typical ambient moisture content.

The uncoated paper feedstock 10 is a continuous sheet or web of any type of paper which is normally coated and then subjected to a later calendering such as a gloss calendering or supercalendering step. Thus it includes the various paper substrates used to prepare label paper, publication guide paper, enamel paper and other well known coated papers. Such papers illustratively have a caliper of about 0.0025 to 0.008 inches and a weight range of about 40 to 80 pounds per 3000 ft.$^2$.

The paper 10 is then coateed on one side thereof with a coating composition 11 which is applied to the paper by a coating roller 12. Any of the many coating compositions known to those skilled in the art can be used and the details thereof need not be repeated herein. Generally most of these coating compositions consist of an aqueous slurry containing a solids fraction which includes a pigment and a binder for joining the pigment to the paper. Illustrative pigments include various types and grades of kaolin clays and titanium dioxide. Illustrative binders include starches, casein and the numerous known polymeric binders. The proportions of pigment to binder, the selection of appropriate pigments and binder, and the amount of coating applied to the paper are known to those skilled in the art. In general, the invention produces beneficial results with any of the common coatings used in paper-making.

The coated paper 13 is then passed through a hot air drying oven 14, or other suitable drying apparatus, to dry the wet coating on its one side and anchor the coating to the surface of the paper. It is generally known that most papers have an ambient moisture content of about 4 to 6% and consequently the moisture content of the paper is reduced to about this level in oven 14. Another reason the coating must be dried is because of the tendency of wet coatings to stick to the roll surfaces of the gloss calender, as discussed previously. Sticking usually becomes a problem as the moisture level approaches about 8 or higher on the coated side, and the usual practice is to insure that the moisture level of the coated side is reduced to a level well below 8% before carrying out the gloss calendering.

Water 16 is applied to the uncoated side of the dried coated paper 15 using a Dahlgren Dampener 17. As pointed out above, the amount of moisture added at this point is important. Enough must be applied to the uncoated side of the paper to raise the overall moisture content of the paper to at least about 8.5%, preferably to at least about 10%, and even more preferably to at least about 12%. Illustrative overall moisture levels in the moistened paper are about 10 to 20%, with a range of about 10 to 15% being preferred. This added moisture forms a zone of high moisture content along the uncoated side of the paper which is believed to reduce internal stresses in the paper substrate and increase its pliability. If the paper contains less than about 8.5% moisture, the subsequent gloss calendering step usually produces significantly less improvement in its printability characteristics. Any suitable means for applying the water to the uncoated side of the paper such as sprays and the like could of course be used in place of the Dahlgren Dampener.

The moistened paper 18 then advances to the gloss calender generally designated by the numeral 19. A gloss calender generally comprises a revolving heated non-deformable roll 20 having a glossy highly polished surface sometimes made from chrome, and at least one deformable roll such as rolls 21, 22 loaded agianst roll 20 to form at least one nip therewith, such as nips 23, 24 in which the coated side of the paper is pressed against roll 20. Although only one nip is required, a plurality of nips can be used. Preferably two nips are used as shown at 23, 24 in the drawing. At least one of the deformable loading rolls 23, 24 should be a hard roll having a Pusey and Jones (hereinafter "P & J") hardness of at least about 90 as measured in accordance with ASTM Standard D 531, 1970 Annual Book of ASTM Standards, Part No. 28—July—Rubber, Carbon Black and Gaskets. In the case where several loaded rolls are used, the other rolls can have lower P & J hardness values, illustratively about 50 to 70. In the preferred embodiment shown in the drawing, roll 22 is a Perkins filled hard roll with a P & J hardness of about 95 and roll 21 is a soft rubber roll with a P & J hardness of about 65.

The moistened paper 18 can be advanced through the gloss calender at a wide range of speeds, illustratively ranging from about 100 to 3,000 feet per minute. Preferred speeds are about 400 to 2,500 feet per minute.

The pressure at each nip in the calender can also vary widely, illustratively ranging from about 125 to 1,500 pounds per linear inch at each nip. Preferred nip pressures are about 250 to 1,000 pounds per linear inch at each nip.

Roll 20 is steam heated and rolls 21, 22 are typically unheated. Illustrative temperatures for the polished roll 20 are about 200° and 450° F., with preferred temperatures being about 275° to 325° F. The moistened paper 18 fed to the calender can be heated or unheated, illustratively being at a temperature ranging from ambient (e.g., 0 to 100° F.) to as high as about 200° F. Preferred paper temperatures are about 140° to 180° F. In the case where the gloss calender is in line with oven 14, these temperatures can be achieved by the hot air heating which occurs in oven 14. In other cases, any suitable means of heating the sheet could be used to place it at the desired temperature for calendering.

It is important that the moistened paper 18 fed to the gloss calender have a moisture content of at least 8.5%, and that most of this water be still on one side of the sheet— the uncoated side. Thus it is preferred that the paper be gloss calendered almost immediately after the water 16 is applied to its uncoated side so there is no time for this water to evaporate to the extent that it lowers the requisite moisture content of the paper. It is equally important that the paper be calendered before the added water can migrate in substantial amounts to the coated surface where it could cause the coating to stick to the drum. Generally, the moisture content of the coated side should be kept below about 8% during the gloss calendering, and preferably at about 6% or below. Where the gloss calender is in line with the coater and moistening apparatus, the speed at which the paper is advancing will usually cause the calendering to occur almost immediately after the paper is moistened, usually within about 10 to 20 seconds or less. Of course, the calendering can be delayed after completion of the moistening step as long as the paper still contains at least about 8.5% moisture and the coated side of the paper is still relatively dry.

Generally when lower temperatures are used on roll 20, higher moisture contents in the paper are desirable. However, excessive application of moisture should be avoided to prevent rapidly over-wetting the coated side of the paper causing it to stick to the calender drums. When operating at lower moisture levels in the range approaching 8.5%, it is preferable to keep the temperature of the paper somewhat lower than at higher moisture levels.

After the gloss calendering is completed, the calendered paper 25 is returned to the oven 14 for further drying usually to the normal ambient moisture level of paper, e.g., about 4 to 6%. This is believed to rigidify the paper and restore the internal stresses which in turn lock in the desirable surface characteristics of the coating produced in the gloss calender as a result of the one-side moistening treatment of the invention.

The finished dried product 26 has printability characteristics superior to those of conventional gloss calendered paper and, when run under preferred conditions, equal to those of supercalendered paper.

The following examples are provided to further illustrate the invention, and particularly to (1) demonstrate the importance of the moisture content of the paper during calendering and (2) to compare the various properties of paper gloss calendered in accordance with the invention with those of conventional supercalendered paper.

EXAMPLES

Several runs were made in which coated paper was moistened on its uncoated side and then gloss calendered under varying process conditions in much the same manner illustrated in the accompanying drawing, except for the fact that pre-coated paper was available as the starting point for the runs. The paper used in each run was commercially available from the International Paper Co. under the trade designation "C-1-S Litho Paper" and is commonly known to the trade as label paper. It was prepared by applying to uncoated paper stock a coating composition consisting of an aqueous slurry containing a major amount of solids. The solids fraction comprised No. 1 kaolin clay pigment, a minor amount of another pigment and 17 parts of binder per 100 parts of total pigment. The coated paper had a loading of about 10 pounds of coating per 3,000 ft.$^2$ on a dry weight basis.

In each run, the coated paper was moistened on its uncoated side using a Dahlgren Dampener generally as shown in the accompanying drawing. It was then calendered in a gloss calender as shown in the drawing comprising a steam heated highly polished roll 20 and two loading rolls 21, 22 loaded against the polished roll. Loading roll 21 was a soft rubber roll having a P & J hardness value of about 65. Loading roll 22 was a Perkins filled roll having a P & J hardness value of about 95. In some cases, the paper was heated prior to the gloss calendering step in hot air oven similar to oven 14 in the drawing, before the sheet was moistened.

The efficacy of the moisture treatment in improving the quality of the gloss calendered paper was determined by obtaining proof press printing data using the product of each run and comparing these data with the same data obtained when the same coated paper was supercalendered, or gloss calendered without moistening the uncoated side. Other conventionally reported data on the respective papers such as gloss, opacity, Sheffield smoothness, Gurley stiffness, etc. were also obtained in most cases.

Printability characteristics were evaluated by four test procedures not believed to be described in the literature. These procedures were as follows:

1. Vandercook Print Smoothness

The sample to be evaluated was printed on a Vandercook proof-press (a letter-press process) at constant ink weight and using a 133 line halftone 5.5 × 10 inch plate having 90,70,50 and 30% coverage areas each about 1⅝ by 2 inches. The press was run at a speed of 90 feet per minute and a printing pressure of 0.012 inch. The ink used was Moss-Coat gloss glue ink (Inmont Corp.) and the ink weight on the sample was 0.029 to 0.035 grams. After allowing the ink to dry, the sample was graded by placing a paper template with 25 holes each 5/32 inch in diameter over the halftones and counting the total number of missing dots in the 25 holes using a magnifying glass. Good sheet smoothness and printability was reflected by a low number of missing dots, with increasing numbers of missing dots being indicative of reduced print smoothness and printability.

2. Gravure Print Smoothness

The sample to be evaluaated was printed on a web-fed Champlain gravure press approximately 17 inches wide using the reverse halftone gravue process. All conditions were comparable to those used on a commercial 1-station web-fed gravure press. A Hurletron Electrosist was not used to print the sample. A reverse halftone Gravure plate was used having a range of 125 to 250 line halftones. After the sample was printed, the number of missing dots from two areas of the print totaling 0.13 square inches were counted. One area was in a zone of high dot density (250 dots per inch) and the other area was in a zone of low dot density (125 dots per inch). The lowest number of missing dots indicated the better printability and sheet smoothness, with an increasing number of dots being indicative of poorer printability and reduced sheet smoothness. The sample was also visually rated by a panel of judges who elevated the sample for such properties as its print coverage, gloss ink hold-out, glossiness, mottle (surface uniformity) and overall appearance. A visual rating of 1 to 6 was then assigned to each sample, with 1 representing the best possible rating and 6 the worst possible rating.

3. GRI Print Smoothness

The sample to be evaluated was printed on a standard small bench scale GRI (Gravure Research Institute) gravure press that printed a sample approximately 4 inches wide. A halftone gravure plate having 125 to 250 line halftones was used. After printing, the sample was visually rated by a panel of judges for such properties as its print coverage, gloss ink hold-out, glossiness, mottle (surface uniformity) and overall appearance. A visual rating of 1 to 6 was then assigned to each sample, with 1 representing the best possible rating and 6 the worst possible rating.

Pertinent data obtained for each run, including the various controls, is presented in Table I.

TABLE I

| | A Supercalendered | B Supercalendered | Gloss Calendered 1 | 2 | 3 | 4 | 5 | 6 | 7 | 8 | 9 |
|---|---|---|---|---|---|---|---|---|---|---|---|
| Run No. | Control[1] | Control[2] | (Control) | | | (Control) | | | (Cont.) | | |
| Process Parameters: | | | | | | | | | | | |
| nip pressure/roll (lb./linear inch) | — | — | 500 | 500 | 500 | 500 | 500 | 500 | 500 | 500 | 500 |
| web speed (ft./min.) | — | — | 455 | 455 | 455 | 455 | 455 | 455 | 455 | 455 | 455 |
| moisture pick-up (lb./3000ft.$^2$) | — | — | 0 | 2.7 | 3.8 | 0 | 2.7 | 3.8 | 0 | 1.5 | 1.5 |
| total moisture of paper (wt. %) | — | — | 0 | 10.5 | 12.3 | 6 | 10.5 | 12.3 | 6 | 8.5 | 8.5 |
| sheet temperature before moistening (°F.) | — | — | ambient | 180–200 | ambient | 180–200 | 180–200 | 180–200 | 200[3] | 200[3] | 180[3] |
| chrome roll temperature (°F.) | — | — | 200 | 200 | 200 | 250 | 250 | 250 | 275 | 275 | 275 |
| Physical Test Data: | | | | | | | | | | | |
| lb./3000 ft.$^2$ | 55.3 | 53.9 | 54.2 | 54 | 54.8 | 53.5 | 53.6 | 53.6 | 54.4 | 54.1 | 54.4 |
| caliper (.001 inch) | 3.5 | 3.4 | 3.9 | 3.4 | 3.5 | 3.5 | 3.4 | 3.4 | 3.9 | 3.9 | 3.9 |
| apparent density (lb./pt.) | 15.8 | 16.1 | 13.8 | 15.6 | 15.5 | 15.3 | 15.9 | 15.9 | 13.9 | 14.0 | 14.0 |
| Sheffield smoothness, units | | | | | | | | | | | |
| coated side | 38 | 29 | 77 | 73 | 82 | 29 | 39 | 32 | 90 | 82 | 92 |
| uncoated side | 129 | 93 | 224 | 138 | 134 | 123 | 116 | 114 | 234 | 204 | 211 |
| Sheffield porosity, units/in.$^2$ | — | 0.7 | — | — | — | 0.8 | 0.7 | 0.6 | — | — | — |
| Opacity, % | 88.4 | 87.6 | 89.1 | 88.3 | 88.7 | 88.5 | 87.5 | 87.3 | 89.4 | 88.5 | 88.9 |
| G.E. Brightness, % | — | 80.6 | — | — | — | 80.8 | 81.3 | 81.2 | — | — | — |
| Gurley stiffness, mg. | | | | | | | | | | | |
| machine direction | 158 | 155 | 184 | 142 | 139 | 193 | 166 | 174 | 187 | 196 | 202 |
| cross direction | 113 | 100 | 120 | 118 | 112 | 123 | 90 | 99 | 134 | 126 | 134 |
| Proof Press Printing Data: | | | | | | | | | | | |
| Coated base gloss values, 75°% | 64 | 63 | 52 | 54 | 56 | 57 | 58 | 60 | 52 | 52 | 51 |
| Vandercook Print Smoothness, number of missing dots at 0.012 in. pressure | 12 | 6 | — | — | — | 18 | 9 | 7 | — | — | — |
| Gravure Print Smoothness | | | | | | | | | | | |
| number of missing dots | 51 | — | 114 | 108 | 83 | — | — | — | 165 | 199 | 82 |
| visual rating | 1 | — | 6 | 5 | 4 | — | — | — | 6 | 6 | 6 |
| GRI Print Smoothness Rating | — | 1 | — | — | — | 3 | 3 | 1 | — | — | — |

| | A Supercalendered | B Supercalendered | Gloss Calendered 10 | 11 | 12 | 13 | 14 | 15 | 16 |
|---|---|---|---|---|---|---|---|---|---|
| Run No. | Control[1] | Control[2] | (Control) | | | | (Control) | | |
| Process Parameters: | | | | | | | | | |
| nip pressure/roll (lb./linear inch) | — | — | 500 | 500 | 500 | 500 | 500 | 500 | 500 |
| web speed (ft./min.) | — | — | 455 | 455 | 455 | 455 | 455 | 455 | 455 |
| moisture pick-up (lb./3000ft.$^2$) | — | — | 0 | 2.7 | 3.8 | 7.2 | 0 | 2.7 | 3.8 |
| total moisture of paper (wt.%) | — | — | 6 | 10.5 | 12.3 | 18.6 | 6 | 10.5 | 12.3 |
| sheet temperature before moistening (°F.) | — | — | 180–200 | 180–200 | 180–200 | 180–200 | ambient | ambient | ambient |
| chrome roll temperature (°F.) | — | — | 275 | 275 | 275 | 275 | 300 | 300 | 300 |
| Physical Test Data: | | | | | | | | | |
| lb./3000ft.$^2$ | 55.3 | 53.9 | 54.3 | 54.3 | 54.3 | 54.5 | 53.0 | 54.1 | 54.0 |
| caliper (.001 inch) | 3.5 | 3.4 | 3.8 | 3.5 | 3.5 | 3.5 | 3.6 | 3.4 | 3.4 |
| apparent density (lb./pt.) | 15.8 | 16.1 | 14.5 | 15.3 | 15.5 | 15.8 | 14.6 | 15.8 | 15.9 |
| Sheffield smoothness, units | | | | | | | | | |
| coated side | 58 | 29 | 81 | 74 | 68 | 69 | 50 | 32 | 46 |
| uncoated side | 129 | 93 | 226 | 142 | 127 | 119 | 142 | 96 | 94 |
| Sheffield porosity, units/in.$^2$ | — | 0.7 | — | — | — | — | 0.6 | 0.6 | 0.4 |
| Opacity, % | 88.4 | 87.6 | 89 | 88.5 | 88.9 | 88.5 | 88.1 | 87.6 | 87.3 |
| G.E. Brightness, % | — | 80.6 | — | — | — | — | 80.6 | 81.1 | 80.1 |
| Gurley stiffness, mg. | | | | | | | | | |
| machine direction | 158 | 155 | 146 | 138 | 141 | 152 | 178 | 180 | 175 |
| cross direction | 113 | 100 | 115 | 110 | 109 | 109 | 106 | 98 | 92 |
| Proof Press Printing Data: | | | | | | | | | |
| Coated base gloss values, 75°, % | 64 | 63 | 56 | 62 | 61 | 64 | 63 | 68 | 64 |
| Vandercook Print Smoothness, number of missing dots at 0.012 in. pressure | 12 | 6 | 29 | 24 | 27 | 14 | 12 | 8 | 6 |
| Gravure Print Smoothness, number of missing dots | 51 | — | 110 | 50 | 72 | 70 | — | — | — |
| visual rating | 1 | — | 5 | 2 | 2 | 3 | — | — | — |
| GRI Print Smoothness Rating | — | 1 | — | — | — | — | 3 | 1 | 1 |

[1]Single run only.
[2]Average values of many runs.
[3]Paper heated by an infra-red heater instead of in hot air oven.

The importance of a moisture content of at least about 8.5% is best shown by the proof press printing data of runs 7–9 and 10 13. Runs 7 and 10 (the controls) produced a product typical of conventional gloss calendered paper which is calendered dry, i.e., with ambient moisture only (about 6%). The printability data of runs 7 and 10, as expected, compare unfavorably to the same data on conventional supercalendered paper shown in Runs A and B. However, once moisture was applied to the uncoated side of the paper in amount sufficient to impart a moisture content of 8.5% (Runs 8, 9), there was a noticeable improvement in the case where the paper was preheated to only about 180° F. (Run 9) but no improvement for the case where it was heated to the higher temperature of 200° F. (Run 8). While the data of run 9 are not as good as for supercalendered paper (Runs A,B), they represent a significant improvement over dry gloss calendered paper (Run 7). The inability to improve the results in Run 8 suggests that a moisture level of about 8.5% is an approximate minimum water content for effective results and that at such low water levels, the paper should be kept cooler for best results as suggested by the results of Run 9.

The remarkable effect of moistening only the uncoated side is further shown by the data of runs 10–13 where the dramatic effect of the added moisture upon printability characteristics is vividly demonstrated over a wide range of moisture contents. Furthermore, the printability data of Run 11 is virtually identical with that for conventional supercalendered paper (Run A) thereby demonstrating the usefulness of the invention in unexpectedly improving the printability characteristics of gloss calendered paper to the level of supercalendered paper. The data of Runs 12, 13, while not as good as that of Run 11, still approximate the values of supercalendered paper, and are far superior to conventional gloss calendered paper not subjected to one-side moistening treatment of the present invention (Run 10).

The above examples and other detailed and specific information presented above was by way of illustration only, and such alterations and modifications thereof as would be apparent to those skilled in the art are deemed to fall within the scope and spirit of the invention, bearing in mind that the invention is defined only by the following claims.

What is claimed is:

1. A process for treating paper coated on one side, which comprises: applying a liquid only to the uncoated side in an amount sufficient to provide a moisture content of about 8.5 to 20% by weight in the paper; and then, gloss calendering the moistened paper with the unmoistened side of the paper pressed against the polished roll of the gloss calender, without moistening the polished roll of the gloss calender.

2. A process for treating paper coated on one side, which comprises: applying water only to the uncoated side in an amount sufficient to provide a moisture content of about 10 to 20% by weight in the paper; and then, gloss calendering the paper with the unmoistened side of the paper pressed against the polished roll of the gloss calender, without moistening the polished roll of the gloss calender.

3. The process of claim 2 wherein the moisture content is about 10 to 15%.

4. A process for treating paper coated on one side, which comprises: applying water only to the uncoated side in an amount sufficient to provide a moisture content of about 8.5 to 20% by weight; and then, almost immediately, gloss calendering the moistened paper by passing the paper through a nip between a revolving heated roll having a highly polished surface and a deformable revolving roll having a P & J hardness of at least 90 to press the coated side of the paper against the heated roll, the heated roll having a temperature of about 200° to 450°F, without moistening the polished roll of the gloss calender.

5. A process for improving the printability characteristics of paper coated only on one side, which comprises: applying water only to the uncoated side in an amount sufficient to provide an overall moisture content of about 10 to 20% by weight in the paper, the water content of the paper being distributed nonuniformly throughout the paper and the added water forming a localized zone of high moisture content at the uncoated side of the paper; and then, gloss calendering the moistened paper at an overall moisture content of at least about 10% and before a sufficient amount of the added moisture migrates to the coated side of the paper and causes the coating to stick to the polished roll of the gloss calender, without moistening the polished roll of the gloss calender.

6. The process of claim 4 wherein the moisture content is about 12 to 20%.

7. The process of claim 4 wherein the heated roll has a temperature of about 275° to 325° F.

8. The process of claim 4 wherein the nip pressure is about 250–1500 pounds per linear inch.

9. The process of claim 4 further including passing the moistened paper through at least one additional nip between the heated roll and at least one additional deformable roll.

10. The process of claim 9 wherein the nip pressure at each nip is about 500 to 1000 pounds per linear inch.

11. The process of claim 10 wherein the P & J hardness of said additional roll is about 50–70.

12. The process of claim 4 wherein the moisture content of the paper is about 12 to 20% and the heated roll has a temperature of about 275° to 325° F., further including passing the moistened paper through at least one additional nip between the heated roll and at least one additional deformable roll having a P & J hardness of about 60 to 70, wherein the nip pressure at each nip is about 250 to 500 pounds per linear inch.

13. A process for treating paper coated on one side only, which comprises: applying water to only the uncoated side of the paper in an amount sufficient to provide a moisture content of about 8.5 to 20% by weight in the paper; then, advancing the moistened paper, at a speed of about 100 to 3000 feet per minute and a temperature ranging from ambient to about 200°F, to a gloss calender, comprising a revolving drum having a highly polished surface heated to about 200° to 450°F and at least one deformable revolving drum forming a nip with the polished drum, the calender operating at a pressure of about 125 to 1500 pounds per linear inch at the nip and the at least one deformable drum having P & J hardness value of at least about 90; and passing the moistened paper through the nip of the calender to press the coated side of the paper against the surface of the polished drum, without moistening the polished drum of the gloss calender.

14. The process of claim 13 wherein sufficient water is applied to provide a moisture content of about 12 to 20% in the paper.

15. The process of claim 13 further including the step of reducing the moisture content of the gloss calendered paper to about 6% by weight or less.

16. The process of claim 5 wherein the overall moisture content of the paper is about 12 to 20% and the moisture content of the coated side is less than about 8% by weight during the gloss calendering.

17. The process of claim 5 further including the step of reducing the moisture content of the gloss calendered paper to about 6% by weight or less.

* * * * *

UNITED STATES PATENT AND TRADEMARK OFFICE

CERTIFICATE OF CORRECTION

PATENT NO. : 3,982,056

DATED : September 21, 1976

INVENTOR(S) : Charles D. Holder, Jr.

It is certified that error appears in the above-identified patent and that said Letters Patent are hereby corrected as shown below:

in the Abstract, line 6, "last" should be -- least -- ;

at column 1, line 22, "80%" should be -- 8% -- ;

at column 1, line 35, "ten-" should be -- te- -- ;

at column 5, line 34, "guide" should be -- grade -- ;

at column 6, line 28, "agianst" should be -- against -- ;

at column 8, line 46, "evaluaated" should be -- evaluated -- ;

at column 8, line 63, "elevated" should be -- evaluated -- ;

at column 9, line 21, in column "A", "38" should be -- 58 -- ;

at column 10, line 12, in column "1", "0" should be -- 6 -- ;

at column 10, line 21, in column "5", "39" should be -- 37 -- ;

at column 10, line 21, in column "9", "92" should be -- 72 -- ;

UNITED STATES PATENT AND TRADEMARK OFFICE

CERTIFICATE OF CORRECTION

PATENT NO. : 3,982,056

DATED : September 21, 1976

INVENTOR(S) : Charles D. Holder, Jr.

It is certified that error appears in the above–identified patent and that said Letters Patent are hereby corrected as shown below:

at column 10, line 61, "10 13" should be -- 10-13 -- ; and at column 12, line 51, after "having" should be -- a -- .

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*